United States Patent [19]

Riepe

[11] 4,063,826

[45] Dec. 20, 1977

[54] FLEXIBLE, OSCILLATING BLADE LIQUID PUMP

[76] Inventor: Waldemar Riepe, Elsa-Brandstrom-Strasse 3, 4500 Osnabruck, Germany

[21] Appl. No.: 688,295

[22] Filed: May 20, 1976

[30] Foreign Application Priority Data

May 20, 1975 Germany ..... 2522309

[51] Int. Cl.[2] ..... F04B 17/00; F04B 19/00

[52] U.S. Cl. ..... 417/410; 417/436

[58] Field of Search ..... 417/322, 410, 436, 572, 417/240; 416/81, 240; 115/28 R, 28 A

[56] References Cited

U.S. PATENT DOCUMENTS

| | | | |
|---|---|---|---|
| 2,152,243 | 3/1939 | Daiger | 417/436 |
| 2,406,499 | 8/1946 | Jandasek | 415/141 |
| 2,646,261 | 7/1953 | Poiroti | 416/81 |
| 3,408,670 | 11/1968 | Wolfe | 115/28 R |
| 3,765,175 | 10/1973 | Ohnaka | 417/410 |
| 3,822,103 | 7/1974 | Hori et al. | 416/240 |
| 3,865,729 | 2/1975 | Baensch | 417/410 |
| 3,865,729 | 2/1975 | Baensch | 417/410 |

FOREIGN PATENT DOCUMENTS

| | | | |
|---|---|---|---|
| 167,983 | 9/1950 | Austria | 417/436 |
| 1,280,528 | 11/1961 | France | 416/81 |
| 600,768 | 12/1959 | Italy | 417/436 |

*Primary Examiner*—William L. Freeh
*Assistant Examiner*—Thomas I. Ross
*Attorney, Agent, or Firm*—Walter Becker

[57] ABSTRACT

A pump for conveying liquid, especially resonance pump, which comprises an alternating current operable oscillating armature which is supported by a leaf spring, and also comprises an elastically flexible thin-walled plate which is likewise supported by the leaf spring and extends into a pump passage through which liquid is conveyed within the pump. The pump furthermore includes electromagnets adapted when energized to cause the armature alternately to swing to one and the opposite side so that the leaf spring and the plate carry out synchronous movements in a direction transverse to the longitudinal axis of the pump. The plate has a considerably lower bending resistance than the leaf spring.

12 Claims, 2 Drawing Figures

FIG.1
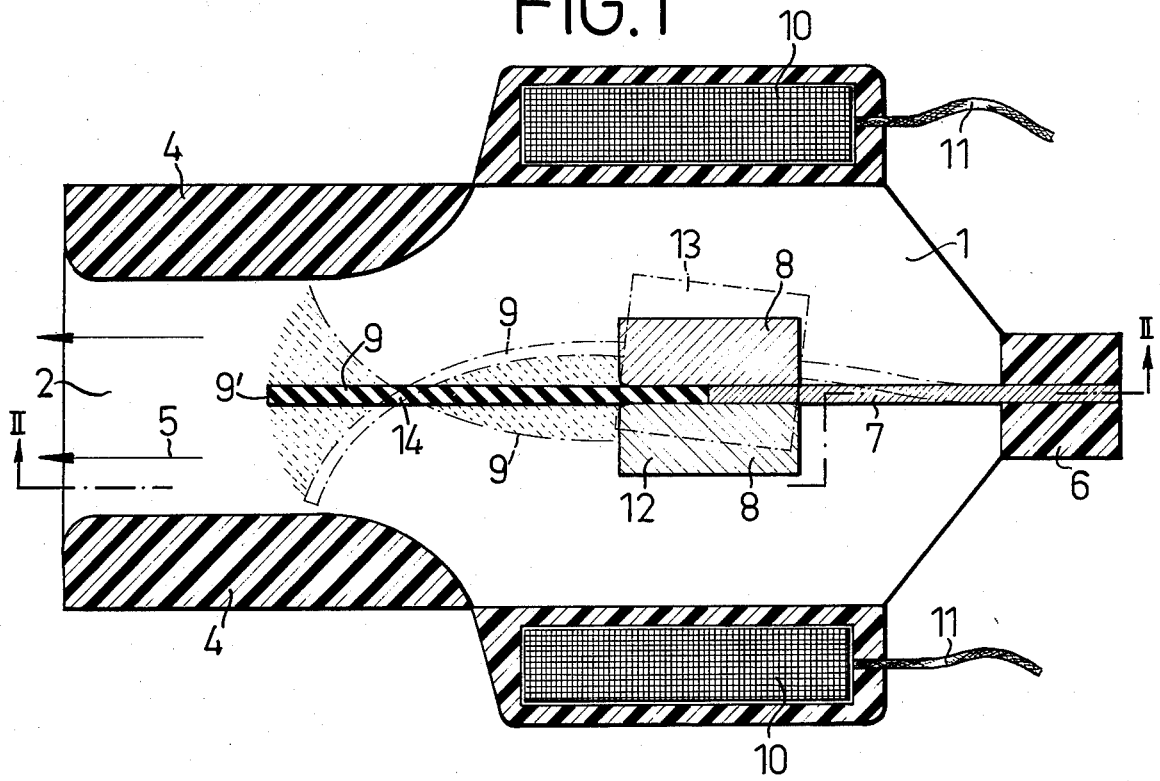
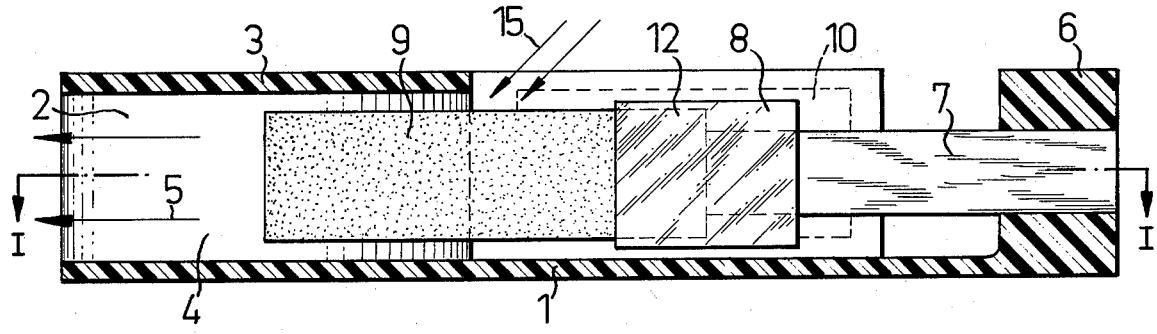
FIG.2

FLEXIBLE, OSCILLATING BLADE LIQUID PUMP

The present invention relates to a pump for liquids having an oscillating armature connected to a leaf spring and having a resiliently flexible plate forming an extension of the leaf spring.

In heretofore known pumps of this type, the leaf spring and the flexible plate are integrally formed in one piece so that the plate forms the outer end of the leaf spring which serves for mounting of the oscillating armature. In a pump of this type the front end plate is unable to execute any adequate pumping strokes.

It is, therefore, an object of the present invention so to improve the above-mentioned pumps that a substantial increase in pumping capacity is attained.

This object and other objects and advantages of the invention will appear more clearly from the following specification in connection with the accompanying drawings, in which:

FIG. 1 is a horizontal central section of a circulating pump according to the invention.

FIG. 2 is a longitudinal section through FIG. 1.

The pump according to the present invention which has an oscillating armature resiliently connected to a leaf spring and is operable by alternating current, includes a resiliently flexible thin-walled plate supported by the armature as an extension of the leaf spring, which plate protrudes into the liquid carrying passage of the pump, said leaf spring and said plate being synchronously displaceable in a transverse direction, and the plate having a considerably lower bending resistance than said leaf spring.

The ratio of the respective rigidity values is preferably between 1:10 to 1:100, but particularly in the order of substantially 1:50.

Such design of the liquid pump according to the invention provides on the one hand the desired mounting of the oscillating armature, while on the other hand the plate extending into the liquid carrying passage will, on account of its relatively high flexibility, be able to carry out fin-like movements with correspondingly long strokes transverse to its own plane. Consequently, the oscillating armature executes rather short side strokes, while the relatively soft plate executes strokes which are much longer than those of the oscillating armature connected to the leaf spring. The oscillating armature supported and guided by the leaf spring is intended merely to reciprocate the flexible plate rhythmically so as to impart thereupon a movement in the manner of the tail fin of a fish. With the pumps in question the alternating driving power frequency is generally about 50 Hz.

The required flexibility and softness of the front end plate will expediently be assured by an adequate choice of the plate material. Preferably, the plate is made of rubber or rubber-like plastics of such low hardness as to be deflected by about 1 mm under the influence of a bending power in the order of 0.5 Pond acting on a free length of about 10 mm. In view of such requirements, the plate should have a hardness of between 55 -65 Shore hardness A. In this way it is ensured that with small strokes of the oscillating armature, the plate will be deflected by substantially larger amounts. The lateral deflection is such that the tip or the free end of the plate moves across the whole or substantially the whole width of the respective liquid carrying passage. Any possible contacts of the plate with the opposite walls of the passage are of no detrimental effect because of the rubber-elastic deformability of the plate.

The liquid carrying passage preferably tapers in the direction of the liquid flow and the plate should protrude into this passage so that the leading edge of the plate be located in the region of the narrowest part of the passage.

Referring now to the drawing in detail, the pump shown therein comprises a base plate 1 which serves for mounting and securing the various parts of the pump and may support means for mounting and securing the pump within an aquarium with which it is intended to be used.

The base plate 1 forms the lower wall of the passage 2 of rectangular cross section through which the liquid to be pumped is conveyed. The passage 2 is further defined by an upper plate 3 and on both sides by contoured members 4. These members 4 and plate 3 define a passage 2 decreasing gradually and continually in cross section in the direction of liquid flow (indicated by arrows) to a normal cross section maintained for substantially one third of its total length and afterwards being enlarged again to its outlet orifice. Such enlargement of the outlet orifice of passage 2, however, is not essential but it is preferred for optimum discharge flow conditions.

At the rear portion of the base plate 1 there is provided a support 6 for a leaf spring 7 which extends towards the passage 2 and at its free end on both sides carries permanent magnets 8. Adjoining the free end of the leaf spring 7 there is provided a rubber plate 9 which at its rear end is retained between the two permanent magnets 8.

On oppositely located sides of the base plate 1 there is provided a pair of small electromagnets 10 with electrical connections 11 while the two permanent magnets 8 are located substantially centrally between the two electromagnets 10. By feeding an alternating field (of a frequency of generally 50 Hz) to the electromagnets 10, the armature 12 comprising the two permanent magnets 8 is caused to oscillate laterally.

The dotted lines 13 in FIG. 1 indicate a deflection to the right, whereby the leaf spring 7 accordingly bends to the right, and after swinging to the right, armature 12 swings to the opposite side to a corresponding extent. The armature 12 is thus moved to the right and left in rapid succession perpendicularly to the plane of the leaf spring 7. In practice the leaf spring 7 is made of toughened plastics material which with an effective length of about 10 mm is subjected to a deflection of 1 mm by a force of about 30 Pond. The plate 9 on the other hand, which with regard to its wall thickness and its effective length has substantially the same mass as the leaf spring 7, consists of rubber having a hardness of about 60 Shore A and already with an effective length of 10 mm and when subjected to a force of 0.5 Pond, will be deflected by 1 mm.

These differing bending resistances of spring 7 and plate 9 bring about a special movement of the plate 9 and thereby cause a substantially high pumping capacity.

If the armature 12 is deflected toward the right, in other words assumes the position shown by the dotted lines 13, the root, i.e., the clamped-in end of plate 9 is deflected together with the oscillating armature, but the free end 9' will move in the opposite direction almost to abutting contact with the pertaining member 4 and vice versa. Such "bending back" is caused by the inherent dynamic conditions of the system and provides node or rest point 14 to be formed substantially half way along the length of the plate 9.

Deflection of the armature to the opposite side produces an opposite bending of the plate 9, whereby the free end 9' moves closer to the last mentioned member 4. The plate 9 moves and oscillates in the hatched region shown and hence is effective over substantially the total cross section of passage 2, since the height of plate 9 is only slightly less than the height of passage 2.

Due to this deformation of the plate, a relatively powerful pumping action and current will occur which starts in the direction of arrows 15 (inlet), and the liquid is pumped through the passage 2 and is discharged in the direction of arrows 5.

It will be evident that the moving masses have to be adapted to the electromagnets 10 to permit the optimum desired deflection of the armature 12.

With an effective length of the leaf spring 7 and the plate 9 of about 10 mm, the wall thickness of the plate 9 should be about 1 mm, and for mechanical reasons the leaf spring 7 is of the same thickness.

It is, of course, to be understood that the present invention is, by no means, limited to the specific showing in the drawing but also comprises any modifications within the scope of the appended claims.

What I claim is:

1. A liquid conveying pump, especially a resonance pump for aquariums, which includes: pump housing means, holding means connected to said housing means, resiliently flexible leaf spring means secured to and supported by said holding means, alternating current operable armature means supported by said leaf spring means and spaced from said holding means in axial direction of said leaf spring means for alternate oscillation toward one side and the opposite side of said pump housing, said pump housing means having liquid inlet means and passage means including liquid outlet means, and flexible thin-walled plate means connected to said armature means axially beyond the free end of said leaf spring means while extending into said passage means for alternately swinging toward one side and the opposite side of said passage means in synchronism with the oscillation of said armature means, said plate means having a considerably lower bending resistance than said leaf spring means, the plate means being made of rubber-like material the cross section of said passage means gradually narrowing from its inner end in the direction toward said liquid outlet means, said plate means extending substantially into said narrowing part of said passage means.

2. A pump according to claim 1, in which the ratio of the bending resistance of said plate means to the bending resistance of said leaf spring means is within the range of from 1:10 to 1:100.

3. A pump according to claim 1, in which the ratio of the bending resistance of said plate means to the bending resistance of said leaf spring means is 1:60.

4. A pump according to claim 1, in which said plate means is resiliently flexible to such an extent that during deflection of said armature means the free end of said plate means is movable at least near to the lateral wall of said passage means.

5. A pump according to claim 1, in which said plate means is flexible to such an extent that its free end is deflected in a direction opposite to the direction of deflection of said armature means.

6. A pump according to claim 1, in which a portion of said plate means in the order of between $\frac{1}{3}$ and $\frac{2}{3}$ of its length remains at least nearly at rest during the oscillating movement of said plate means.

7. A pump according to claim 1, in which said plate means has a length of about 10 mm and a wall thickness of about 1 mm.

8. A pump according to claim 1, in which said leaf spring means has approximately the same wall thickness as said plate means.

9. A pump according to claim 1, in which said armature means includes two permanent magnets arranged on opposite sides of said leaf spring means and said plate means.

10. A pump according to claim 1, in which the height of said plate means substantially corresponds to the height of said passage means.

11. A pump according to claim 1, in which the plate means made of rubber-like material has a shore hardness A from 55 to 65.

12. A pump according to claim 11, in which the Shore hardness A is 60.

* * * * *